US006732717B2

(12) United States Patent
Braun et al.

(10) Patent No.: US 6,732,717 B2
(45) Date of Patent: May 11, 2004

(54) FUEL RAIL PERMEANT COLLECTION SYSTEM

(75) Inventors: Charles W. Braun, Livonia, NY (US); Keith A. Confer, Flushing, MI (US); Kenneth W. Turner, Mendon, NY (US); Curtis D. Lamb, Scottsville, NY (US)

(73) Assignee: Delphi Technologies, Inc., Troy, MI (US)

( * ) Notice: Subject to any disclaimer, the term of this patent is extended or adjusted under 35 U.S.C. 154(b) by 87 days.

(21) Appl. No.: 10/124,788

(22) Filed: Apr. 17, 2002

(65) Prior Publication Data

US 2003/0196644 A1 Oct. 23, 2003

(51) Int. Cl.[7] ..... F02M 37/04
(52) U.S. Cl. ..... 123/516; 123/518; 123/198 E
(58) Field of Search ..... 123/456, 514, 123/516, 518–520, 198 E, 198 D, 198 DB

(56) References Cited

U.S. PATENT DOCUMENTS 4,702,202 A * 10/1987 Hensel et al. ..... 123/456
5,003,933 A * 4/1991 Rush, II et al. ..... 123/519
5,353,767 A * 10/1994 Carbone et al. ..... 123/470
5,357,931 A * 10/1994 Semence ..... 123/456
5,816,213 A * 10/1998 Gaviani et al. ..... 123/198 E
6,067,953 A 5/2000 Bloomer
6,167,855 B1 * 1/2001 Mammarella et al. ... 123/90.38
6,308,686 B1 * 10/2001 Mammarella et al. ..... 123/470
6,422,191 B1 * 7/2002 Braun et al. ..... 123/184.21
6,499,466 B2 * 12/2002 Lee ..... 123/456

* cited by examiner

*Primary Examiner*—Thomas N. Moulis
(74) *Attorney, Agent, or Firm*—Patrick M. Griffin

(57) ABSTRACT

A fuel rail permeant collection system includes a substantially impermeable enclosure surrounding a fuel rail on an internal combustion engine. Preferably, the enclosure is in communication with air intake means for the engine, for example, the intake manifold or runners from the manifold to the engine cylinders, such that fuel collected by the enclosure can be evaporated and passed into the intake means for combustion by the engine. The system may be included in a vehicle vapor purge circuit from a fuel tank emissions-control canister system.

6 Claims, 2 Drawing Sheets

FUEL RAIL PERMEANT COLLECTION SYSTEM

TECHNICAL FIELD

The present invention relates to fuel injector rails for internal combustion engines; more particularly, to devices for capturing stray fuel emissions (permeants) permeating through such fuel injector rails; and most particularly, to a system for capturing stray fuel permeants from a fuel injector rail and controllably releasing captured permeants into an engine's air intake means.

BACKGROUND OF THE INVENTION

Fuel injectors for controllably metering fuel to the combustion cylinders of internal combustion engines are well known. Modern engines typically incorporate a dedicated fuel injector for each cylinder, the fuel injector being disposed in the intake port or runner from the intake manifold to the cylinder. For ease and reliability in manufacturing, the fuel injectors typically are mounted by their inlet ends at appropriate intervals into a rigid fuel supply line harness, appropriately configured to place the injection end of each fuel injector into its corresponding injection socket in the manifold runner. Such a harness is known as a fuel injector rail, or simply a fuel rail.

Typically, the fuel injectors are sealed into the rail and into the engine by elastomeric seals such as O-rings. Such seals are excellent at preventing liquid leakage but are nonetheless somewhat permeable to hydrocarbons such as gasoline or diesel fuel, which permeation can result in environmental contamination, reduced fuel efficiency, and a potentially explosive atmosphere in the vicinity of the engine.

Also, since the fuel rails are typically exposed in the engine compartment, the rails and associated injectors are subject to water, road salt, dirt, and other contaminants introduced into the engine compartment. They are exposed to the potential of physical damage as well.

It is a principal object of the present invention to prevent escape of fuel permeants from a fuel rail into the environment.

It is a further object of the invention to increase fuel efficiency by capturing and using permeated fuel.

It is yet a further object of this invention to provide a housing in which the fuel rails and injectors reside to protect them from damage from the underhood environment.

SUMMARY OF THE INVENTION

Briefly described, a fuel rail permeant collection system in accordance with the invention includes a substantially impermeable enclosure surrounding a fuel rail for use on an internal combustion engine. Preferably, the enclosure is in communication with air intake means for the engine, for example, the intake manifold or runners from the manifold to the engine cylinders, such that fuel collected by the enclosure can be evaporated and passed into the intake means for combustion by the engine. The system may be included in a vehicle vapor purge circuit from a fuel tank emissions-control canister system.

BRIEF DESCRIPTION OF THE DRAWINGS

These and other features and advantages of the invention will be more fully understood and appreciated from the following description of certain exemplary embodiments of the invention taken together with the accompanying drawings, in which.

DESCRIPTION OF THE PREFERRED EMBODIMENTS

Figure 1:
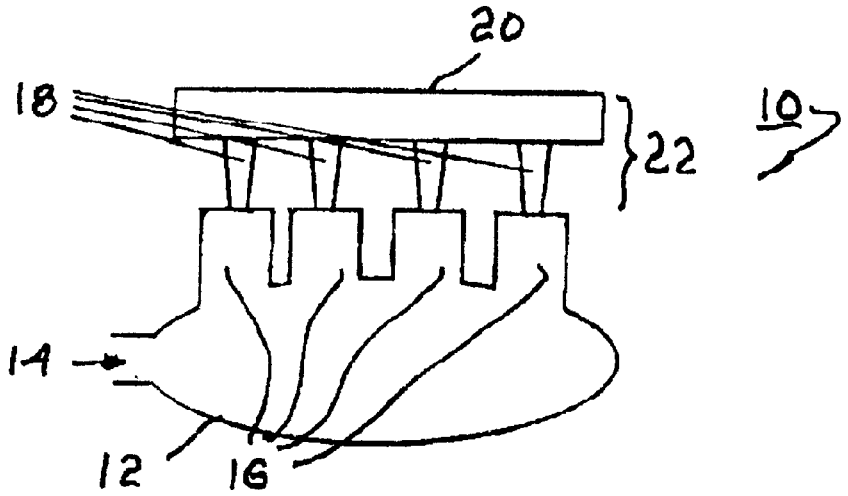
FIG. 1 (PRIOR ART)
FIG. 1 is a schematic view of a portion of a prior art engine assembly, showing an intake manifold having four runners and having four fuel injectors connected to the runners and to a fuel feed rail.

Referring to FIG. 1, a port-injected internal combustion engine 10 includes an air intake manifold 12 for taking in outside air 14 and distributing the air to a plurality of engine cylinders (not shown) via runners 16 leading from the manifold 12 to the cylinders, there being four cylinders supplied by four runners in the example shown. A fuel injector 18 supplies fuel from a fuel manifold 20 to each runner 16, the fuel injectors being sealed against liquid leakage at their connections to the runners and to the fuel manifold. The fuel manifold 20 and injectors 18 are preferably pre-assembled as a subassembly known in the art as a "fuel rail" 22 prior to overall assembly of engine 10.

Figure 2:
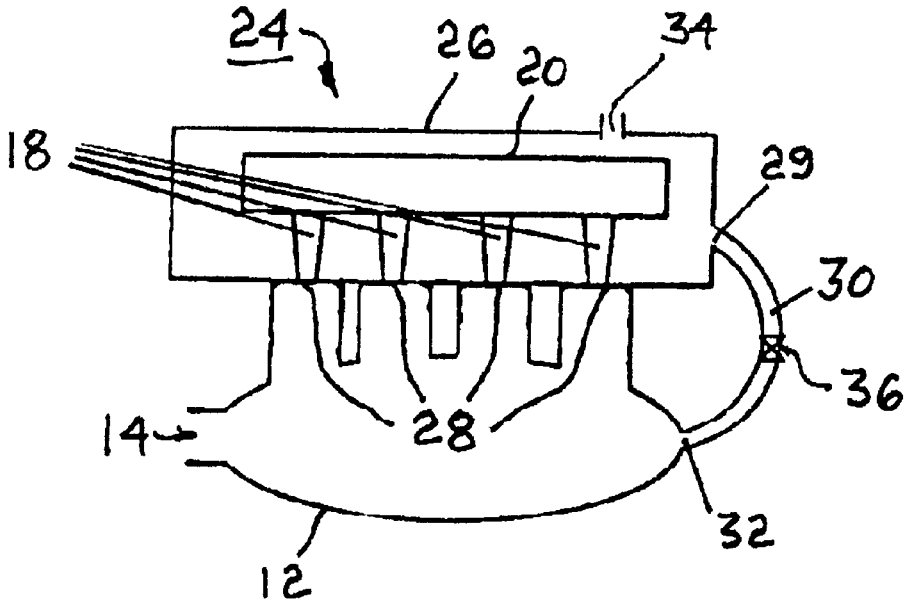
FIG. 2 is a schematic view like that shown in FIG. 1, showing a first embodiment of a fuel-rail permeant collection system in accordance with the invention.

Referring to FIG. 2, a first embodiment 24 in accordance with the invention includes a fuel-impermeable enclosure 26 which surrounds fuel rail 22 and is distinct from intake manifold 12. Enclosure 26 is provided with apertures 28 through which fuel injectors 18 extend to form their conventional couplings to the runners. Apertures 28 may be sealed around each of the injectors but preferably are sealed to each of the runners. Enclosure 26 may be formed of any substance that impedes permeation of fuel, such as, for example, metal or high-density plastic. Enclosure 26, of course, must have other sealable openings (not shown) for a wiring harness and a fuel line to reach fuel rail 22, and also may have a removable panel or other openable member to allow access to the fuel rail for assembly or service.

Over time, fuel vapors permeating through seals in fuel rail 22 accumulate and may condense in enclosure 26; thus, the enclosure is preferably provided with an outlet port 29 connected via tubing 30 to an inlet port 32 in intake manifold 12. Further, in embodiment 24, enclosure 26 may be optionally vented at vent port 34. Without optional vent 34, vacuum in inlet manifold 12 draws air from enclosure 26, through tubing 30, and into the intake manifold where it mixes with intake air 14 for subsequent combustion. With optional vent 34, vacuum in inlet manifold 12 draws air from vent port 34 through enclosure 26 and tubing 30 into the intake manifold where it mixes with intake air 14 for subsequent combustion. With vent port 34, a continuous purging of fuel captured in enclosure 26 can occur. Preferably, tubing 30 is provided with a restriction 36 having a predetermined open area for regulating the flow of air and evaporated fuel from enclosure 26 without significantly affecting the vacuum level in manifold 12.

Figure 3:
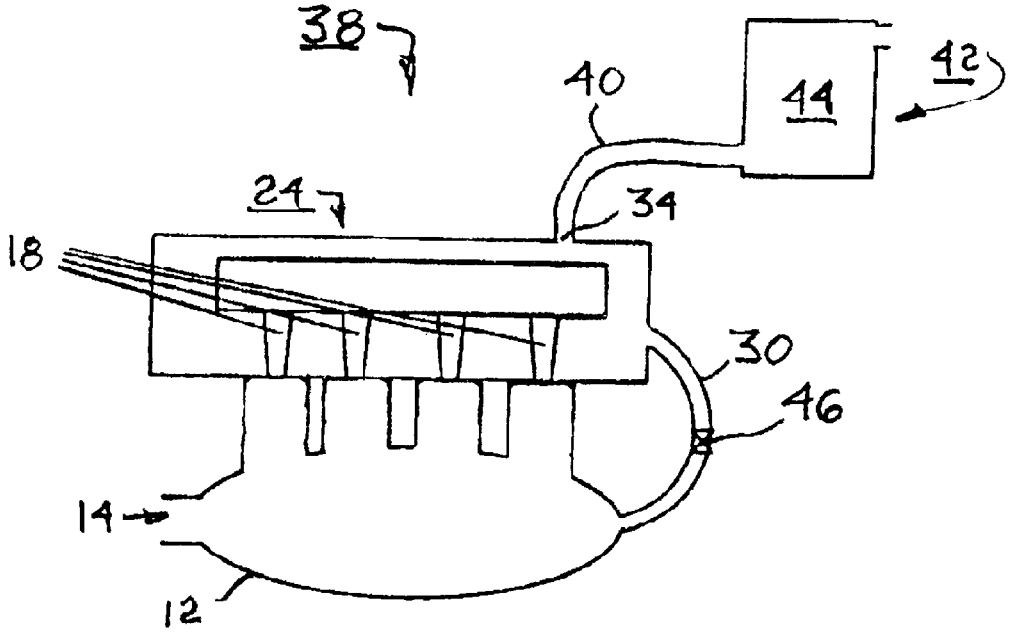
FIG. 3 is a schematic view showing a second embodiment.

Referring to FIG. 3, in a second embodiment 38 in accordance with the invention, enclosure 26 containing fuel rail 22 is connected via vent port 34 and tubing 40 to a fuel tank emissions recovery canister system 42 such as is installed conventionally on vehicles employing internal combustion engines. As is well known in the automotive art, such a canister 44 collects fuel vapors expelled from a vehicle's fuel tank (not shown) under normal operation of the vehicle and during refueling of the tank. The vapors are then stripped from the canister and are fed into the intake manifold of the associated engine. Thus, second embodiment 38 is readily formed simply by disposing first embodiment 24 between recovery system 42 and intake manifold 12. As is further known in the art, system 42 typically includes a solenoid-actuated valve for opening and closing the pathway from the canister system to the engine manifold as directed by an engine control module. In second embodiment 38, restriction 36 may be replaced by a solenoid-actuated valve 46 relocated from canister system 42. Thus, in second embodiment 38, embodiment 24 becomes a functional part of recovery system 42.

Figure 4:
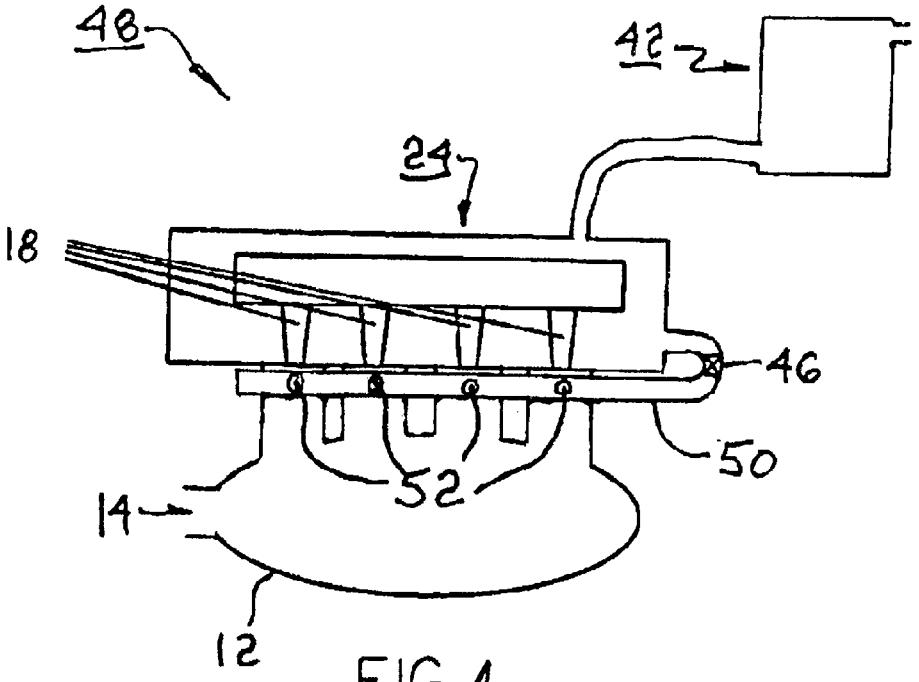
FIG. 4 is a schematic view showing a third embodiment.

Referring to FIG. 4, a third embodiment 48 is functionally identical to second embodiment 38 in recovery and stripping of fuel emissions. However, in some applications it may be desirable to distribute the stripped fuel and air mixture directly to the runners rather than generally to the intake manifold. Thus, tubing 30 in embodiments 1 and 2 is replaced by a distribution manifold 50 connected via ports 52 to each of the runners 16.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A fuel permeant collection system for a fuel rail on an internal combustion engine having air intake means including a manifold connected by runners to cylinders thereof, the system comprising:

a) an enclosure surrounding said fuel rail for capturing said permeant fuel, said enclosure including an inlet port; and b) a communication between said enclosure and said air intake means for passage of said captured fuel from said enclosure into said engine, wherein said system is connected via said inlet port to an outlet port of a fuel-tank emissions collection system.

2. A system in accordance with claim 1 wherein said communication includes a flow restriction.

3. A system in accordance with claim 1 wherein said communication includes a solenoid-actuated valve.

4. A system in accordance with claim 1 wherein said communication extends between said enclosure and said air intake manifold.

5. A system in accordance with claim 1 wherein said communication extends between said enclosure and said runners.

6. An internal combustion engine having air intake means including a manifold connected by runners to cylinders thereof, comprising a fuel permeant collection system for a fuel rail including, an enclosure surrounding said fuel rail for capturing said permeant fuel, said enclosure including an intake port, and a communication between said enclosure and said air intake means for passage of said captured fuel from said enclosure into said engine, wherein said system is connected via said inlet port to an outlet port of a fuel-tank emissions collection system.

* * * * *